United States Patent [19]

Shimizu

[11] 4,222,849

[45] Sep. 16, 1980

[54] PROCESS OF LIQUEFACTION OF COAL

[76] Inventor: Kunitoshi Shimizu, No. 600, Kowata, Chigasaki-shi, Kanagawa-ken, Japan

[21] Appl. No.: 54,677

[22] Filed: Jul. 5, 1979

Related U.S. Application Data

[63] Continuation-in-part of Ser. No. 881,721, Feb. 27, 1978, abandoned.

[51] Int. Cl.[3] ..... C10G 1/00; B01J 37/00

[52] U.S. Cl. ..... 208/8 LE; 44/1 R; 44/1 B; 252/425

[58] Field of Search ..... 208/8 LE; 44/1 R, 1 B; 252/425

[56] References Cited

U.S. PATENT DOCUMENTS

| | | | |
|---|---|---|---|
| 2,095,863 | 10/1937 | Freeman | 208/8 LE |
| 2,202,901 | 6/1940 | Dreyfus | 208/8 X |
| 2,556,496 | 6/1951 | Hickey | 208/8 X |
| 3,642,607 | 2/1972 | Seitzer | 208/8 LE |
| 4,057,484 | 11/1977 | Malek | 208/8 LE |
| 4,082,694 | 4/1978 | Wennerberg et al. | 252/425 X |
| 4,085,029 | 4/1978 | Malek | 208/8 LE |
| 4,121,910 | 10/1978 | Stambaugh | 208/8 LE X |

*Primary Examiner*—Delbert E. Gantz
*Assistant Examiner*—William G. Wright
*Attorney, Agent, or Firm*—Kane, Dalsimer, Kane, Sullivan & Kurucz

[57] ABSTRACT

Liquefaction of coal is realized in a chemical manner without employing high temperature and high pressure, only by such a process, wherein granulated coal is first soaked in aqueous solution of caustic soda and subsequently pulverized after it is taken out and dried, and then, the so obtained coal powder is mixed with an aqueous solution containing sodium hydroxide and organic carboxylic acid by agitation, thereafter the mixture is kept still for sufficient time until the coal becomes ominous of liquefaction, and finally, the mixture is heated at a temperature from 90° to 150° C. with further addition of water.

8 Claims, No Drawings

PROCESS OF LIQUEFACTION OF COAL

CROSS-REFERENCE TO RELATED APPLICATIONS

This application is a continuation-in-part of U.S. application Ser. No. 881,721, filed Feb. 27, 1978, now abandoned.

BACKGROUND OF THE INVENTION

The present invention relates to a process of liquefaction of coal in a chemical manner without employing high temperature and high pressure.

For liquefying coal, there have been known processes, wherein coal is decomposed under high temperature and high pressure. However, in these processes, very large amount of energy is required to obtain liquefied product useful as a resource of energy and is therefore unprofitable. Moreover, it is impossible to carry out the liquefaction of coal in large scale by these processes.

Therefore, the object of the present invention is to propose a novel process for liquefying coal, which does not show such defects.

The inventor has found, that coal can be liquefied at an yield of up to about 80% of its original weight, by a procedure, wherein coal crushed into granular form is soaked in aqueous solution of sodium hydroxide so as to penetrate the solution into the coal body and is subsequently pulverized on a pulverizer, after it is taken out and dried, to a particle size smaller than 100-mesh, and then, the so obtained coal powder is mixed with an aqueous solution containing sodium hydroxide and organic carboxylic acid by agitating the mixture and the mixture is subsequently held still for a sufficient time until the coal becomes ominous of liquefaction, and finally, the mixture is heated at a temperature from 90° to 150° C. with further addition of water.

SUMMARY OF THE INVENTION

The present invention relates therefore to a process of liquefaction of coal, comprizing, impregnating a granulated coal with aqueous solution of caustic soda by soaking it in said solution, pulverizing the so treated coal, after it is taken out and dried, to a particle size smaller than 100-mesh, mixing the so obtained coal powder with an aqueous solution containing sodium hydroxide and organic carboxylic acid, keeping the mixture still for a sufficient time until the coal becomes ominous of liquefaction, and finally, heating the mixture at a temperature from 90° to 150° C. with further addition of water thereto.

The liquefied product of coal obtained by the process according to the present invention is composed of substances which are particularly useful as fuel oil and as starting materials for many chemical products.

In the process according to the present invention, every sort of coal can be used, for example, smokeless coal, bituminous coal, brown coal, lignite and so on.

DETAILED DESCRIPTION OF PREFERRED EMBODIMENTS

In the process according to the present invention, the granulated coal can preferably be supplied from conventional crushing machine in an average grain size of at the most about 3 cm and, in particular, about 2 cm.

As to the aqueous solution of caustic soda for soaking the granulated coal, especially a solution prepared by dissolving sodium hydroxide in demineralized water may be preferred. The concentration of this solution may desirably lie in the range of from 1 to 5%, specifically from 2 to 4% and, especially, a concentration of about 3% is recommended. It is particularly preferred to use the solution in an abount the same with the granulated coal in the weight basis. While the time, during which the granulated coal is soaked, should vary in accordance with the size of the granulated coal and the concentration of the solution etc., usually it takes therefor more than several hours, and particularly, 10 hours or more.

The coal which has been subjected to the soaking treatment is dried, preferably as sufficiently as possible. For this, drying by a conventional drying apparatus, and also, drying in the sun may be recommended.

For pulverizing the coal after the drying, it is enough to use a conventional pulverizer. The average size of coal powder produced should preferably be smaller than 100-mesh (JIS A 1102) and particularly a size of about 150-mesh may be preferred.

The aqueous solution for treating the pulverized coal according to the present invention should contain sodium hydroxide and organic carboxylic acid in a molar ratio between 0.5:1.5 and 1.5:0.5 and preferably in particular between 0.9:1.1 and 1.1:0.9. The total content of sodium hydroxide and organic carboxylic acid contained in the solution should preferably amount at highest to about 10%, especially to 4.5–6.0%, by weight with respect to water. Here, the use of demineralized water is recommended also for preparing this solution. The amount of the pulverized coal to be mixed with this solution may preferably be 0.5–2 times of the amount of this solution in weight basis. As for the organic carboxylic acid to be incorporated in this solution, for example, lower carboxylic acids which are substantially liquid at normal temperature and exhibit boiling points lying in the range from 50° to 170° C., such as, formic acid, acetic acid, propionic acid and butyric acid, saturated and unsaturated aliphatic monocarboxylic acids, such as, acrylic acid and methacrylic acid etc., aliphatic polycarboxylic acids, such as, malonic acid, succinic acid and adipic acid etc., and aromatic carboxylic acids, such as benzoic acid etc., may be enumerated. Above all, formic acid and acetic acid have been approved.

The duration of stillstand after the mixing of pulverized coal with the solution of sodium hydroxide and carboxylic acid before the commencement of heating corresponds to the time required for the coal to be denatured and coming to show a first sign of liquefaction, which lies in general in the range from about 5 to about 10 hours.

Directly after the coal becomes ominous of liquefaction, a supplemental amount of demineralized water is added, occasionally in a separate vessel, in an amount from 0.3 to 1 part per one part of the pulverized coal. After the supplemental addition of demineralized water, the mixture is heated at a temperature of from 90° to 150° C., preferably from 110° to 120° C. Though the duration of the heating depends on the temperature employed, it lies in general in the range of from about 30 minutes to about 2 hours.

After the heat treatment, it is recognizable, that up to about 80% of coal originally present has been liquefied floating above the aqueous layer. The separation of this liquefied product can easily be carried out by a conventional method.

It is possible to promote the liquefaction of coal, by adding an adequate amount of phenol or naphthalene beforehand before the heating. These compounds may have a function of promoting the oxidation reaction during the liquefaction of coal.

The liquefied product of coal according to the present invention can either be used as such for fuel or be subjected to sorting out into each useful constituent compound.

As described above, the process of liquefaction of coal according to the present invention reveals many advantages, since it does not require high temperature nor high pressure and moreover the apparatus to be employed is very simple and, furthermore, the each procedure in the process is also simple enough, so that the process can be carried out very economically with a possibility of practicing in a large scale.

In the following, the process according to the present invention will be described in detail by way of a concrete example. It should be noted however, that the present invention will not be restricted only in such a concrete example.

EXAMPLE

A bituminous coal is crushed using a hammer crusher into grains having an average grain size of 2 cm. 10 kg of this granulated coal are charged into a vessel having a capacity of 180 l and containing an aqueous solution prepared by dissolving 300 g of sodium hydroxide in 10 kg of demineralized water. After the charge, it is kept still for 20 hours. Then, the coal is taken out and dried in the sun for 24 hours. The dried granulated coal is then pulverized on a pulverizer to an average particle size of 150-mesh. 10 kg of this coal powder are introduced into an aqueous solution prepared by dissolving 300 g of sodium hydroxide and 400 g of acetic acid in 10 kg of demineralized water and the mixture is stirred until a better mixing state has been reached. The mixture is then held still for 10 hours. Then, the mixture is transferred into a kettle and, after an addition of 5 kg of demineralized water thereto, the mixture is boiled for 1 hour at a temperature of 120° C. An oily product is obtained in the upper layer of the kettle content in an amount of 7.92 kg. The analytical data for the oily product is as follows:

specific gravity—approximately 0.795
flash point—58° C.
kinematic viscosity (30° C.)—1.45 CST
sulpher content—less than 0.01% by weight
temperature at 50% distillation—198.4° C.

What is claimed is:

1. A process of liquefaction of coal, to form an oily product comprising, impregnating a granulated coal with aqueous solution of caustic soda by soaking it in said solution, pulverizing the so treated coal, after it is taken out and dried, to a particle size smaller than 100-mesh, mixing the so obtained coal powder with an aqueous solution containing sodium hydroxide and organic carboxylic acid, keeping the mixture still for a sufficient time until the coal shows a first sign of liquefaction by the initial appearance of an oily product on the surface of the mixture and, finally, heating the mixture at a temperature from 90° to 120° C. with a further addition of water thereto.

2. The process according to claim 1, wherein the average grain size of the granulated coal is at most 3 cm and the average particle size of the pulverized coal is about 150-mesh.

3. The process according to either one of claims 1 and 2, wherein the organic carboxylic acid is lower carboxylic acid.

4. The process according to either one of claims 1 to 3, wherein the concentration of aqueous solution of caustic soda for soaking the granulated coal lies in the range of from 1 to 5%, specifically from 2 to 4% and is especially about 3%.

5. The process according to either one of claims 1 to 4, wherein the molar ratio of sodium hydroxide to organic carboxylic acid in the aqueous solution for treating the pulverized coal lies between 0.5:1.5 and 1.5:0.5, especially between 0.9:1.1 and 1.1:0.9.

6. The process according to either one of claims 1 to 5, wherein the total content of sodium hydroxide and organic carboxylic acid in the solution for treating the pulverized coal amounts to less than about 10% by weight with respect to the water.

7. The process according to either one of claims 1 to 6, wherein the amount of the supplemental water added corresponds 0.3–1 part per one part of the pulverized coal in weight basis.

8. The process according to either one of claims 1 to 7, wherein phenol or naphthalene is added before heating the pulverized coal mixture.

* * * * *